US011540694B2

(12) United States Patent
Kessler et al.

(10) Patent No.: US 11,540,694 B2
(45) Date of Patent: Jan. 3, 2023

(54) METHOD FOR SETTING A TIME OF A RELEASE OF A CLEANING AGENT DURING A CLEANING CYCLE IN A HOUSEHOLD APPLIANCE

(71) Applicant: Henkel AG & Co. KGaA, Duesseldorf (DE)

(72) Inventors: Arnd Kessler, Monheim am Rhein (DE); Thomas Juckel, Monheim (DE); Rayko Enz, Heilbronn (DE); Volker Hoppe, Heilbronn (DE); Lars Zuechner, Langenfeld (DE); Robert Ruiz Hernandez, Duesseldorf (DE); Wolfgang Wick, Dormagen (DE); Ingo Hardacker, Hamminkeln (DE)

(73) Assignee: HENKEL AG & CO. KGAA, Duesseldorf (DE)

( * ) Notice: Subject to any disclaimer, the term of this patent is extended or adjusted under 35 U.S.C. 154(b) by 70 days.

(21) Appl. No.: 16/767,518

(22) PCT Filed: Jan. 22, 2019

(86) PCT No.: PCT/EP2019/051422

§ 371 (c)(1),
(2) Date: May 27, 2020

(87) PCT Pub. No.: WO2019/170313

PCT Pub. Date: Sep. 12, 2019

(65) Prior Publication Data

US 2020/0399813 A1 Dec. 24, 2020

(30) Foreign Application Priority Data

Mar. 9, 2018 (DE) ..... 10 2018 203 588.1
Jun. 27, 2018 (DE) ..... 10 2018 210 496.4

(51) Int. Cl.
*A47L 15/00* (2006.01)
*D06F 33/37* (2020.01)
(Continued)

(52) U.S. Cl.
CPC ..... *A47L 15/0026* (2013.01); *D06F 33/37* (2020.02); *A47L 15/0028* (2013.01);
(Continued)

(58) Field of Classification Search
CPC ..... A47L 15/00–508
See application file for complete search history.

(56) References Cited

U.S. PATENT DOCUMENTS 5,603,233 A * 2/1997 Erickson ..... A47L 15/0021 68/12.02
5,681,400 A * 10/1997 Brady ..... A47L 15/0055 422/111
(Continued)

FOREIGN PATENT DOCUMENTS

DE 10204455 A1 * 8/2003 ..... A47L 15/0049
DE 202007018460 U1 9/2008
(Continued)

OTHER PUBLICATIONS

EPO, International Search Report issued in International Application No. PCT/EP2019/051422, dated Apr. 3, 2019.

*Primary Examiner* — Spencer E. Bell
*Assistant Examiner* — Omair Chaudhri
(74) *Attorney, Agent, or Firm* — Lorenz & Kopf, LLP

(57) ABSTRACT

A method for setting a time of a release of a cleaning agent during a cleaning cycle in a household appliance includes obtaining an evolution over time of a local parameter inside the appliance, the local parameter comprising an acceleration induced by the cycle or a temperature inside the appliance; obtaining reference patterns of evolutions of the local parameter during a cycle comprising different cleaning steps including a step adapted for releasing the cleaning agent at a predetermined adapted time; comparing the evolution of the local parameter to the reference patterns and identifying a cleaning step within the cycle when a similarity between a reference pattern and the evolution is above a predetermined threshold, and setting the release of the agent at the predetermined adapted time within the identified cleaning step when the identified step corresponds to a step adapted for releasing the agent.

10 Claims, 4 Drawing Sheets

(51) Int. Cl.

| | |
|---|---|
| ***A47L 15/44*** | (2006.01) |
| ***D06F 103/26*** | (2020.01) |
| ***D06F 105/42*** | (2020.01) |
| ***D06F 39/02*** | (2006.01) |
| *D06F 34/28* | (2020.01) |

(52) U.S. Cl.
CPC ..... *A47L 15/4454* (2013.01); *A47L 15/4463* (2013.01); *A47L 2401/03* (2013.01); *A47L 2401/32* (2013.01); *A47L 2501/07* (2013.01); *D06F 34/28* (2020.02); *D06F 39/02* (2013.01); *D06F 2103/26* (2020.02); *D06F 2105/42* (2020.02)

(56) References Cited

U.S. PATENT DOCUMENTS 5,807,438 A * 9/1998 Lansbergen ..... C11D 3/386 510/226
2003/0182732 A1* 10/2003 Davenet ..... D06F 34/22 68/17 R
2004/0088796 A1* 5/2004 Neergaard ..... D06F 39/024 68/17 R
2004/0154644 A1* 8/2004 Kim ..... D06F 33/34 8/158
2009/0194562 A1* 8/2009 Kessler ..... D06F 39/022 222/63
2009/0314313 A1* 12/2009 Classen ..... A47L 15/44 134/25.2
2011/0077772 A1* 3/2011 Buck ..... D06F 34/14 700/240
2011/0209729 A1* 9/2011 Beaudet ..... A47L 15/0021 134/18
2011/0262318 A1* 10/2011 Hofte ..... A47L 15/4481 422/272
2014/0084024 A1* 3/2014 Benda ..... A47L 15/4472 222/113
2016/0145548 A1* 5/2016 Van Tol ..... A47L 15/4472 510/224
2018/0258575 A1* 9/2018 Cooke ..... D06F 39/024

FOREIGN PATENT DOCUMENTS

DE 102007042863 A1 * 3/2009 ..... A47L 15/0055
DE 102007042863 A1 3/2009
WO 02077353 A1 10/2002
WO WO-02077353 A1 * 10/2002 ..... A47L 15/0055
WO WO2002077353 A1 * 10/2002
WO 2006114134 A1 11/2006

* cited by examiner

METHOD FOR SETTING A TIME OF A RELEASE OF A CLEANING AGENT DURING A CLEANING CYCLE IN A HOUSEHOLD APPLIANCE

CROSS-REFERENCE TO RELATED APPLICATION

This application is a U.S. National-Stage entry under 35 U.S.C. § 371 based on International Application No. PCT/EP2019/051422, filed Jan. 22, 2019, which was published under PCT Article 21(2) and which claims priority to German Application No. 10 2018 210 496.4, filed Jun. 27, 2018, which claims priority to German Patent Application No. 10 2018 203 588.1, filed Mar. 9, 2018, and which are all hereby incorporated in their entirety by reference.

TECHNICAL FIELD

The present disclosure relates to the field of cleaning programs and more particularly to methods enabling an optimized timing of the output of cleaning agents in a household appliance such as a dishwashing machine. Embodiments described herein are particularly suitable for dishwashing machines comprising a dosing unit with controllable output of cleaning agents.

BACKGROUND

Household appliances are used to clean stains on textiles, typically cleaned in a washing machine, or objects such as dishes, cups or other utensils typically cleaned using a dishwashing machine. Washing machines and dishwashing machines are very convenient devices that allow users to save time while achieving a satisfactory level of cleanliness in a more environmentally friendly way than manual wash.

When cleaning textiles in a washing machine or utensils in a dishwashing machine, users expect all stains to be eliminated. In dishwashing machines, a further expectation is to have no or few droplets on the utensils, so that they come out clean and dry out of the machine.

In a dishwashing machine, it is typically possible to select between an intensive wash program or a more economical program, each program generally differing by its maximum temperature, duration, number of cleaning cycles amount and type of cleaning agent used. Some machines have further capabilities and can adapt the cleaning strategy on the go upon determining a level of dirtiness of the inserted items or load of items to be cleaned.

Typical cleaning cycles in a dishwashing machine include a first "main wash" cycle, during which cleaning agents are released in the first minutes after filling of the dishwashing machine with water. The temperature is typically increased beyond about 40° C. This main wash cycle is followed by one or more rinse cycles until the end of the cleaning cycle which leaves the objects inside the dishwashing machine dry.

Generally, dishwashing involves the use of cleaning agents such as dishwashing liquids, tablets or pouches. The cleaning agents can be either dispensed from a dispensing unit that is an integral part of the household appliance, or from a removable device independent from the household appliance and that is placed inside a chamber of the household appliance. During the cleaning cycle, it is customary to dispense a first enzyme phase in the first minutes of the main wash cycle, followed by the dispensing of an alkaline agent a few minutes later. A third cleaning agent (generally called finisher) is advantageously further administered during the last rinse cycle.

It is possible to offer a fine control over the timing of the outputting of cleaning agents in a household appliance. Such a control can be enabled either by using an automatic dosing unit placed inside the household appliance (drummer of a washing machine or inner space of a dishwashing machine), or for example by the dosing tank of the appliance itself, the appliance then being capable of controlling the release of the cleaning agents.

It has been identified that appliances sometimes dynamically adapt the cleaning program based on information on the load in the appliance or level of dirtiness of the items to be cleaned. For example, it is possible that a program adds a pre-wash cycle in addition to a main wash cycle, which adds confusion to the time when the cleaning agent should be dispensed. Furthermore, some machines can run programs that do not follow known cleaning patterns as those described above. In such cases, a predefined and fixed timing for the outputting of cleaning agents would lead to unsatisfactory results.

For the above reasons, a method for determining the timing of release of cleaning agents in a household appliance is sought.

SUMMARY

To address the above need, the present disclosure provides a method for setting a time of a release of a cleaning agent during a cleaning cycle in a household appliance, the method comprising: obtaining an evolution over time of at least one local parameter inside the household appliance, the at least one local parameter comprising at least one among an acceleration induced by the cleaning cycle in the household appliance and a temperature inside the household appliance; obtaining reference patterns of evolutions over time of the at least one local parameter inside household appliances during at least one cleaning cycle comprising different cleaning steps, a cleaning step among the different cleaning steps being adapted for releasing the cleaning agent at a predetermined adapted time; comparing the evolution over time of the at least one local parameter to the reference patterns and identifying a cleaning step within the cleaning cycle when a similarity between a reference pattern and the evolution over time of the at least one local parameter is above a predetermined threshold, and setting the release of the cleaning agent at the predetermined adapted time within the identified cleaning step when the identified cleaning step corresponds to a cleaning step adapted for releasing the cleaning agent.

In another embodiment, a non-transitory computer readable storage medium having stored thereon a computer program comprising instructions for execution of a method for setting a time of a release of a cleaning agent during a cleaning cycle in a household appliance is provided. In the embodiment, the method includes measuring an evolution over time of at least one local parameter inside the household appliance, the at least one local parameter comprising at least one among an acceleration induced by the cleaning cycle in the household appliance and a temperature inside the household appliance; obtaining reference patterns of evolutions over time of the at least one local parameter inside household appliances during at least one cleaning cycle comprising different cleaning steps, a cleaning step among the different cleaning steps being adapted for releasing the cleaning agent at a predetermined adapted time; comparing the evolution over time of the at least one local parameter to the reference patterns and identifying a cleaning step within the cleaning cycle when a difference between a reference pattern and the evolution over time of the at least one local parameter is below a predetermined threshold, and setting the release of the cleaning agent at the predetermined adapted time within the identified cleaning step when the identified cleaning step corresponds to a cleaning step adapted for releasing the cleaning agent.

Embodiments herein may be particularly suitable to be implemented on a dosing unit that may be part of the household appliance or independent devices removable from the household appliance. The measurement of local parameters can be implemented by accelerometers such as MEMS (micro-electromechanical systems) or NEMS (nano-electromechanical systems), piezoelectric detectors or any other form of acceleration or vibration sensor.

Alternatively instead of measuring the accelerations (vibrations) inside the household appliance, the evolution of temperature over time can be monitored to identify different cleaning steps in a cleaning cycle. Both local parameters (vibrations and temperature) can also be monitored in the household appliance.

Household appliances for which the method is particularly suitable include washing machines and dishwashing machines. A particularly advantageous and efficient mode provides significant improvement in the management of the output of cleaning agents in dishwashing machines, which generally rely on the use of different cleaning agents that need to be dispensed at precise steps of a cleaning cycle. The present disclosure is particularly efficient at optimizing the timing of the dispensing of finishers by identifying the last rinse cycle and being capable of distinguishing it from an intermediary rinse cycle when the cleaning cycle runs several rinse cycles in a sequence.

The method of the present disclosure uses patterns in the vibrations or temperature of the household appliance to identify the current cleaning step that is run by the program of the appliance. The acceleration information, providing insight into the vibrations that occur, have a signature that can be compared to a database or simply to expected trends. For example, the spraying arm of a dishwasher rotates when a "main wash" cycle or "rinse" cycle is ongoing. A reduction in vibrations can be an indicator of the end of a cycle and the beginning of another one or the end of the cleaning process. Each cleaning step can be further identified by analyzing the patterns of the oscillations (frequency, amplitude), and this signature may also give insight into the current state of the machine (whether it requires maintenance or replacement of the spraying arm or other components for example). The patterns of the evolution of the acceleration over time can also identify the machine type or the program that is run, beyond merely identifying one step of a cleaning program. Acceleration information can be advantageously further coupled with temperature information for more accurate determinations of the current cycle run by the household appliance, or with any other parameter providing insight into the features of the cleaning step or cleaning cycle that is run by the appliance.

Measurements are compared to reference patterns, that can for example be taken from a database accessible online or stored in a storage unit. The storage unit may be part of a mobile device (such as a mobile phone for example) capable of communicating with the device implementing the method (such as a dosing unit). Such a storage unit may also be part of the household appliance or part of the device (e.g.: dosing unit) itself.

The term "difference" can also be replaced by the term "similarity" to describe how close a measured evolution of a local parameter and reference patterns are. This similarity can typically refer to a correlation value that is above about 0.75, preferably above about 0.8 most preferably above about 0.9. The difference between a measured evolution and reference patterns would then correspond to a correlation value lower than about 0.25 preferably lower than about 0.2, most preferably lower than about 0.1. One possibility of comparing reference patterns to measured values of the evolution over time of a local parameter is to make a correlation of both signals, over at least a portion thereof. Other, simpler means may also be used, such as counting the number of similar features between the two signals (increase of the amplitude of oscillations over a certain period of time, frequency of oscillations matching within a about 20% relative difference range, preferably within about 10% most preferably within about 5% difference range for example). The patterns may further also be general trends such as an increase followed by a decrease in amplitude/frequency, over a fixed period of time. It may also merely be an expected sequence, such as pauses in oscillations followed by a new start in oscillations (or a significant reduction of the amplitude of vibrations followed by a significant increase thereof). Alternatively, the "similarity" may be viewed as a match between the measured evolution over time and the reference pattern, within an error range of about 20% for example. In other words, the term "similarity" is to be understood as encompassing a difference in signals or features of the evolution over time of the local parameter and the reference patterns that is below a certain threshold, the threshold being for example a relative difference of about 20% or less, more preferably about 10% or less, most preferably about 5% or less or for example at least one or at least two non-matching features.

When specific cleaning steps within the cleaning range are thus identified, the method may select the most appropriate time for dispensing cleaning agents based on stored predetermined adapted times. These times can also be extracted from a database and can be updated by using improved data or analysis of past cleaning cycles on the same household appliance.

The method of the present disclosure as well as all its further embodiments are advantageously implemented by a processor that may be part of a dosing unit, for example an automatic dosing unit removable from the household appliance. Some or parts of the method can be implemented from a processor located outside of this dosing unit, either in the household appliance, in a mobile device (such as a mobile phone, tablet or the like), or in a computer or server for example.

According to an embodiment, the method may further comprise releasing the cleaning agent at said predetermined adapted time within the identified cleaning step.

In other words, the present disclosure may also be viewed as being a method for dispensing or releasing a cleaning agent in a household appliance at a predetermined adapted time.

According to an embodiment, the reference patterns may comprise recordings of the evolution over time of the at least one local parameter during cleaning cycles run by the household appliance in previous uses thereof.

According to an embodiment, the at least one local parameter may further comprise at least one among:

a temperature inside the household appliance;

a magnetic field inside the household appliance;

a conductivity of a fluid inside the household appliance;

a pH level in a fluid inside the household appliance;

a turbidity of a fluid inside the household appliance;

a concentration of a composition in a fluid inside the household appliance.

These further local parameters can advantageously be monitored alongside the acceleration, in order to corroborate the information extracted with respect to the current step of the cleaning cycle using acceleration or temperature measurements. A particularly advantageous couple of parameters to be used together are acceleration (indicative of vibrations induced in the household appliance during a cleaning cycle) and temperature, but other information can further corroborate the teachings of these two parameters. Having such further information renders the identification of cleaning steps more efficient, in particular when coupled with an artificial intelligence, deep learning, predictive analytics approach to analyzing patterns in the evolution of data and comparison thereof with reference data. After each "wash cycle", the temperature typically drops before the beginning of a rinse cycle. It further rises during the rinse cycle before the end of the cycle. One exception is the use of a "drying cycle" using zeolite in some dishwashers, that do not rely on an increase in the temperature for the final rinse cycle.

According to an embodiment, the cleaning steps comprising a main wash cycle, and a rinse cycle, the method may further comprise:

releasing a first cleaning agent when the identified cleaning step corresponds to the main wash cycle, and releasing a second cleaning agent when the identified cleaning step corresponds to the rinse cycle.

The identified cleaning step is associated with a predetermined adapted time for the release of the first cleaning agent and the second cleaning agent. However, the predetermined adapted time is a parameter that can be altered during the method, in particular to take into account the specifics of the cleaning steps as it is run by the household appliance. In that respect, a previous recording of a full cycle run on the household appliance provides the right information to select the most relevant predetermined adapted time for the dispensing of cleaning agents in each cleaning step of the cleaning cycle.

Furthermore the method may further comprise:

identifying a subsequent rinse cycle occurring after the rinse cycle based on the evolution over time of the at least one local parameter;

releasing the second cleaning agent during the subsequent rinse cycle.

This embodiment is particularly advantageous in situations in which the household appliance dynamically adapts the cleaning strategy based for example on the load of items inside the machine. This may render the parameterization of the dispensing of cleaning agents confusing, especially when the latter is implemented by independent dosing units removable from the household appliance.

Should an intermediary rinse cycle be misinterpreted as the last rinse cycle, a further dispensing of the second cleaning agent (typically a finisher in dishwashing machines) may be scheduled at the next rinse cycle. Patterns of the evolution over time of the at least one local parameter are then recorded for further better identification of the cleaning cycle's specifics for this household appliance.

According to an embodiment, the method may further comprise:

identifying a subsequent rinse cycle occurring after the rinse cycle based on the evolution over time of the at least one local parameter;

identifying a last rinse cycle in the cleaning cycle of the household appliance based on the evolution over time of the at least one local parameter;

updating the reference patterns by storing a recording of the evolution over time of the at least one local parameter during at least a portion of the cleaning cycle, and during a subsequent cleaning cycle of the household appliance, an evolution over time of the at least one local parameter during the subsequent cleaning cycle being identified as matching patterns of the stored recording:

releasing the second cleaning agent during the determined last rinse cycle.

This approach enables the method to correct errors in the timing of the dispensing of some cleaning agents during a first run of a program. A learning algorithm, that relies on information extracted from past cleaning cycles can regularly update the reference patterns that are used to determine whether and when cleaning agents should be dispensed. The purpose of the optimization of the dispensing of the cleaning agents is to make sure that the right compositions are administered inside the household appliance at the right time for increased efficiency of the cleaning process. In a dishwasher, an enzyme phase and a composition having a pH value above about 7 are administered during a "main wash" cycle. A composition adapted for lowering the surface tension of the fluid inside the household appliance (this fluid being generally called "treatment liquid"), the finisher, is to be administered at the last rinse cycle. Should a rinse cycle incorrectly be identified as being a last rinse cycle, it is advantageous to update the reference patterns upon recognition of the mistake to avoid reproducing it during a similar run of the cleaning process with this household appliance.

The term "matching" is to be interpreted in the same way as the term "similarity" defined above. Two patterns can match within an error range of about 20%. This matching can be determined either by correlating the two patterns, counting the number of features they have in common or by analyzing the values of amplitude and frequency of the evolution over time of the at least one local parameter in both patterns.

According to an embodiment, the method may further comprise:

identifying a subsequent rinse cycle occurring after the rinse cycle based on the evolution over time of the at least one local parameter;

updating the reference patterns by storing a recording of the evolution over time of the at least one local parameter during at least a portion of the cleaning cycle, and during a subsequent cleaning cycle of the household appliance, an evolution over time of the at least one local parameter during the subsequent cleaning cycle being identified as matching patterns of the stored recording:

releasing an amount of the first cleaning agent during the subsequent rinse cycle.

In this embodiment, advantage can be taken of the existence of more than one cleaning step that can be assimilated to a "main wash cycle" in household appliances. In dishwashers, this may occur during longer cleaning programs that comprise several rinse cycles or in programs that repeat the same cleaning cycle more than once. Such a situation may for example occur when items in the dishwasher have been identified as being particularly dirty and require a more intensive and longer cleaning process. Only the last rinse cycle is relevant for the delivery of the finisher (composition adapted for reducing surface tension in the treatment liquid).

For a better cleaning efficiency, the first cleaning agent may be administered during at least some of the other cleaning steps that can be assimilated to a main wash cycle occurring prior to the last rinse cycle.

According to an embodiment, the method may further comprise:

identifying a nature of the cleaning cycle of the household appliance based on the evolution over time of the at least one local parameter, the nature being one among a first cleaning cycle comprising two cleaning steps and a second cleaning cycle comprising more than two cleaning steps;

adjusting the predetermined adapted time for releasing the cleaning agent and/or an amount of cleaning agent released based on the identified nature of the cleaning cycle.

The first cleaning cycle is generally called "short cleaning cycle" or "short program" as it lasts generally no longer than about one hour. The second cleaning cycle is generally called "long cleaning cycle" or "long program" as it typically can last two hours or more and comprise several rinse cycles, some of which may be as intensive in the washing efficiency as the main wash cycle. Advantage can be taken during these long cleaning cycles of these additional cleaning steps to dispense a further amount of the first cleaning agent (typically an enzyme phase and a composition having a pH value above about 7).

The short program may for example be either selected by a user or automatically selected by the household appliance, for example upon determining that the load of items in the household appliance or their dirtiness level does not require wasting more energy and chemistry for the cleaning process.

The long program is typically adapted for heavier cleaning processes in case of a larger load of items or dirtier items.

According to an embodiment, the nature of the cleaning cycle being a first cleaning cycle comprising a main wash cycle and a rinse cycle, the method may further comprise:

releasing a first composition containing an enzyme and a second composition having a pH above about 7 during the main wash cycle, releasing a third composition adapted for reducing the surface tension of a fluid in the household appliance during the rinse cycle.

According to an embodiment, the nature of the cleaning cycle being a second cleaning cycle comprising a main wash cycle and at least two rinse cycles including a last rinse cycle, the method may further comprise:

releasing a first composition containing an enzyme and a second composition having a pH above about 7 during the main wash cycle and during at least one rinse cycle other than the last rinse cycle, releasing a third composition adapted for reducing the surface tension of a fluid in the household appliance during the last rinse cycle.

According to an embodiment, the method may further comprise:

receiving a feedback on a quality of the cleaning cycle from a user;

modifying the predetermined adapted time for the cleaning step and/or associating a different amount of cleaning agent to be released during a cleaning step adapted for releasing the cleaning agent based on the received feedback.

The present disclosure also pertains to a non-transitory computer readable storage medium having stored thereon a computer program comprising instructions for execution of a method as described above for determining a time of release of a cleaning agent in a household appliance.

In other words, the present disclosure also pertains to a computer program product comprising instructions for execution of a method as described above for determining a time of release of a cleaning agent in a household appliance.

BRIEF DESCRIPTION OF THE DRAWINGS

The present disclosure will hereinafter be described in conjunction with the following drawing figures, wherein like numerals denote like elements, and.

DETAILED DESCRIPTION

The present disclosure pertains to a method that uses an analysis of the evolution over time of at least one local parameter inside a household appliance to determine when a cleaning agent should be dispensed. The local parameter is at least the vibrations measured inside the household appliance or the temperature inside the household appliance, but can also be coupled with other local parameters.

A learning strategy is implemented to correct possible errors in the identification of cleaning steps in a program run by a household appliance, in order to avoid repetition of these errors and to improve the cleaning efficiency. This method is particularly suitable for controlling and optimizing the dispensing of cleaning agents from dosing units, that can be removable devices placed inside the household appliance.

Figure 1:
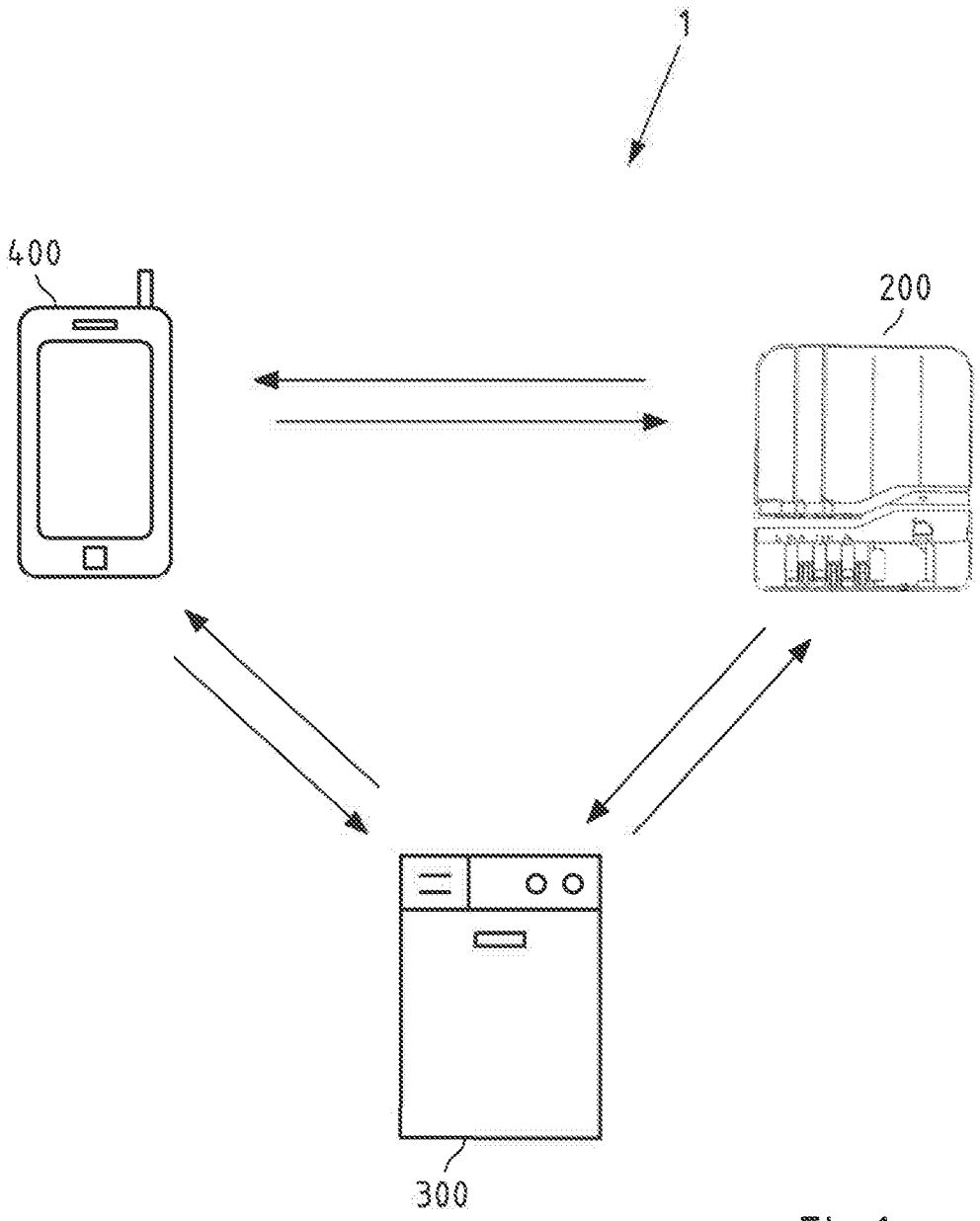
FIG. 1 shows a set of devices that can be used to implement the method according to an exemplary embodiment.

FIG. 1 illustrates a system 1 for which an exemplary method is particularly suitable. Such a system 1 may typically comprise a dosing unit 200, comprise valves capable of releasing different cleaning agents stored in cartridges; a household appliance 300 such as a dishwashing machine or a washing machine, and a mobile device 400 such as a portable phone, a tablet or smart watch for example.

The dosing unit 200 is adapted to be placed inside the household appliance in order to dispense the cleaning agents from the cartridges upon activation of the valves. The dosing unit 200 may comprise sensors capable of measuring the acceleration inside the household appliance. These sensors can be MEMS or NEMS, piezoelectric sensors, any type of accelerometer or sensor capable of reacting to a vibration. Electronic circuits required to acquire, store, transmit or process the signals measured with such sensors may also be part of the dosing unit 200. The dosing unit may advantageously be capable of establishing a communication with the household appliance 300 and/or the mobile device 400, in order to acquire or transmit information or instructions from these devices.

It should be noted that the dosing unit 200 may alternatively also be an integral part of the household appliance 300.

The mobile device 400 can typically be used as a user interface to let the user interact with the household appliance 300 or the dosing unit 200, for example via an "app". Such an "app" can be used to query feedback from the user once a cleaning cycle is over to rate the quality of the cleaning process, in order to integrate that information into a database in order to adjust the timing of the dispensing of cleaning agents and/or dosage of the cleaning agents that are dispensed. The mobile device 400 may advantageously also be used to display information that is relevant regarding the identified current status of the cleaning process or of the household appliance 300, as identified for example using the sensors placed on the household appliance 300 and/or the dosing unit 200. The "app" can be used to parameterize the dosing unit 200 and/or the household appliance 300. More generally, interaction with the household appliance 300 and/or the dosing unit 200 can be done during the cleaning cycle as well in order for example to monitor its current status.

The household appliance 300 is advantageously a dishwasher. However, it could be another appliance performing a cleaning process, such as a washing machine, or even a dryer. In case of a dryer, the dispensing unit 200 may for example dispense fragrances.

Figure 2:
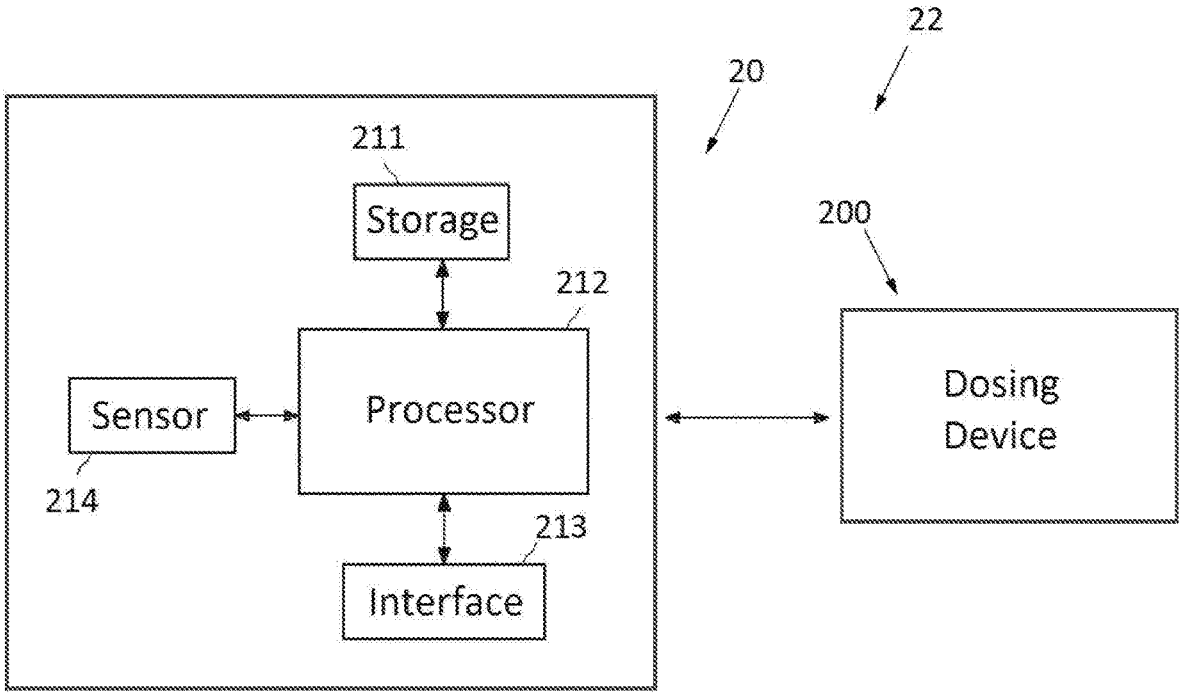
FIG. 2 shows a schematic representation of the components that can be part of a system implementing the method according to an embodiment.

Further details on the structure of the electronic components that might be found in the dosing unit 200, the household appliance 300 or the mobile device 400 are illustrated FIG. 2. Some of the elements may be further found on distant devices such as computers or servers, in particular in order to process information with more powerful devices and reduce the cost and complexity of the electronics found on the dosing unit 200 or the household appliance 300.

As shown in FIG. 2, a non-transitory data processing unit 20 typically is capable of exchanging information with the dosing unit 200. This non-transitory data processing unit 20 comprises at least one processor 212, a storage medium 211. At least one sensor 214, in particular the sensor that is used to measure vibrations inside the household appliance 300 also exchange information with the processor. It is possible to have an interface 213 in the non-transitory data processing unit 20, although this interface is advantageously rather included in the mobile device 400 or the household appliance 300. The non-transitory data processing unit 20 can be in the dosing unit 200, as one element thereof. Or else be a separate entity that merely communicates with the dosing unit 200.

The method of the present disclosure relies on an analysis of vibration patterns in a household appliance during a cleaning cycle in order to identify cleaning steps and adapt the timing of the dispensing of cleaning agents. The method is capable of correcting errors upon first incorrect dispensing of cleaning agents by updating reference patterns, keeping a record of vibration or temperature patterns (or those of other local parameters) in memory and identifying similar patterns in later cleaning cycles to improve the timing of the dispensing of cleaning agents.

Figure 3:
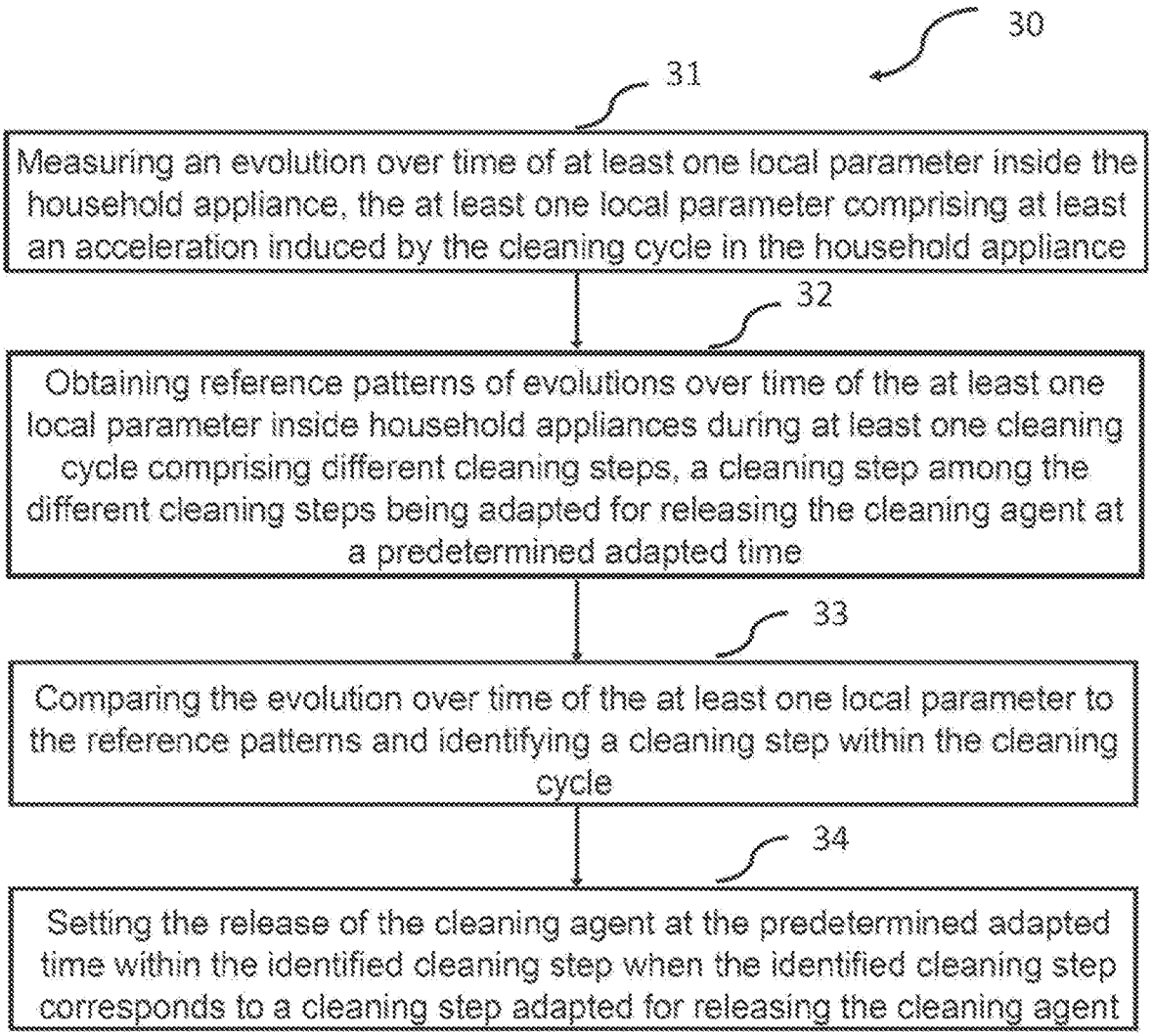
FIG. 3 shows a simplified workflow of a method according to an exemplary embodiment.

FIG. 3 provides an overview of the steps of such a method 30 for determining a time of a release of a cleaning agent during a cleaning cycle in a household appliance in a flowchart.

First, the method consists in obtaining 31 an evolution over time of at least one local parameter inside the household appliance 300, the at least one local parameter comprising at least an acceleration induced by the cleaning cycle in the household appliance 300. This evolution over time is typically obtained by measuring vibrations and/or temperature inside the household appliance using an accelerometer.

Other than the acceleration, the temperature inside the household appliance 300 may also be measured and analyzed alongside the acceleration. Other local parameters can for example include: a magnetic field inside the household appliance; a conductivity of a fluid inside the household appliance; a pH level in a fluid inside the household appliance; a turbidity of a fluid inside the household appliance; a concentration of a composition in a fluid inside the household appliance. Specific sensors can advantageously be used to obtain the values of these different parameters. These sensors can be part of the dosing unit 200 or part of the household appliance 300 for example.

Then, the method is continued by obtaining 32 reference patterns of evolutions over time of the at least one local parameter inside household appliances during at least one cleaning cycle comprising different cleaning steps, a cleaning step among the different cleaning steps being adapted for releasing the cleaning agent at a predetermined adapted time.

In other words, the method accesses a database that is used to provide guidelines on how the data measured regarding acceleration inside the household appliance 300 is to be interpreted. Such a database can be stored in the storage medium 211 or accessed in a distant computer or server, for example wirelessly. The information can for example be retrieved online.

The cleaning steps typically comprise a "main wash" cycle, one or more "rinse" cycles and a "filling" cycle during which a treatment fluid is introduced in the household appliance for example. It the case of a dishwasher, it is customary to dispense a first cleaning agent comprising an enzyme phase at the beginning of the main wash cycle, typically a few minutes after the start of the cleaning cycle. This release of an enzyme phase is typically followed by a dispensing of a composition having a pH above about 7, typically an alkali composition whose pH is above about 9. The last rinse cycle is generally rendered more efficient by dispensing a finisher, which is a composition adapted for reducing the surface tension of the treatment fluid in the household appliance.

The predetermined adapted time for the dispensing of each of these compositions is typically stored in a memory but can alternatively or further be parameterized in order to better take into account user feedback on the efficiency of a cleaning process or adapt to the specifics of each household appliance. Indeed, household appliances generally differ by the programs that they run, by each main wash or rinse cycle, or the amount of these cycles, which can be configured by household manufacturers in different ways. Furthermore, users can often combine different program settings when parameterizing a cleaning cycle, which leads to a multitude of combinations of lengths, intensities, local parameter values during the cleaning cycle that is run. Some household appliances comprise features that enable them to analyze the properties of the items they are to clean. This can lead to a dynamic update of the cleaning cycle, to which the dosing unit 200 needs to adapt as well.

The method continues by comparing 33 the evolution over time of the at least one local parameter to the reference patterns and identifies a cleaning step within the cleaning cycle when a similarity between a reference pattern and the evolution over time of the at least one local parameter is above a predetermined threshold. This comparison to information typically stored in a database enables the method to recognize, characterize portions of a cleaning cycle run by the household appliance and adapt its cleaning agent dispensing strategy.

Indeed, another step of the method consists in setting 34 the release of the cleaning agent at the predetermined adapted time within the identified cleaning step when the identified cleaning step corresponds to a cleaning step adapted for releasing the cleaning agent.

Typically, the dispensing of a cleaning agent is operated at times that are extracted from reference values accessed by the method of the present disclosure. However, the information that is accessed is advantageously updated continuously in order to correct mistakes that can occur upon a first inaccurate identification of a last rinse cycle for example. By recording cycles run on the household appliance, the method creates a bigger and richer database of reference patterns that can enable the method to correct errors and ever more accurately identify the last rinse cycle in the cleaning programs of dishwashers.

If the finisher is for example dispensed too early in a rinse cycle during one cleaning cycle, the method of the present disclosure can identify this error by recognizing that the rinse cycle was later followed by another rinse cycle. At least parts of the values of the evolution over time of the local parameter can be recorded for future identification of this specific cleaning cycle to avoid dispensing the finisher too early.

In order to correct the error it is further possible, during the same cleaning cycle, to dispense another amount of finisher during a subsequent rinse cycle, in order to maker sure that some amount of finisher is dispensed during the last rinse cycle. Such an approach might remain optional.

Furthermore, if it is identified that the household appliance runs more than one rinse cycle, and that some rinse cycles can be assimilated to another "main wash" cycle, another amount of enzyme containing composition and composition having a pH above 7 can be dispensed during such a rinse cycle. The finisher is then dispensed only later during the last rinse cycle of the cleaning cycle.

Another improvement that the method of the present disclosure can implement, in order to go beyond the mere recommendations set by the predetermined adapted times that can be stored in a database, is to try to change the time of the dispensing of a cleaning agent within an identified cleaning step deemed to be suitable for the dispensing of a cleaning agent.

Such a modification of the "predetermined adapted time" can in particular be implemented when taking into account a feedback from a user, to try different dosing strategies during subsequent cleaning cycles in the same household appliance. The dispensing can be either programmed for an earlier time within the cleaning step, later, or split into several smaller events within the cleaning step.

Alternatively or in addition to this alteration of the time of the dispensing, the amount of cleaning agent dispensed can also be modified to better meet the needs of the user for a better cleaning result. Should the cleanliness of the items after a cleaning cycle be deemed unsatisfactory, the amount of cleaning agent dispensed might be increased upon recognition of the same cleaning cycle via the patterns of the evolution over time of the local parameter. Should the cleanliness be deemed satisfactory, a reduction of the amount dispensed might be tried at a subsequent cleaning cycle to fine tune the amount of cleaning agent used and to reach a better cost efficiency and environmental friendliness.

Figure 4:
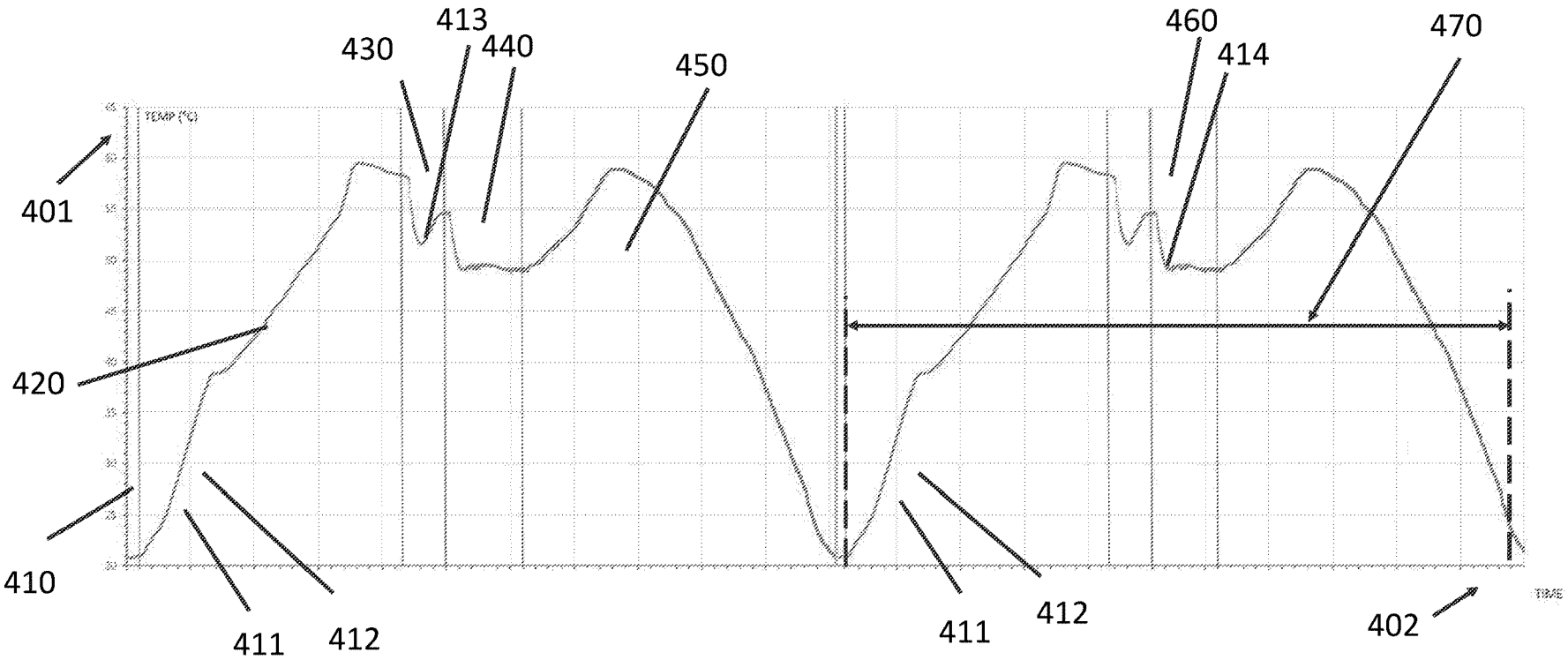
FIG. 4 shows an exemplary graph of the evolution of temperature measured inside a dishwasher during a long cleaning cycle comprising more than one rinse cycles.

FIG. 4 provides a graph illustrating the evolution over time of a local parameter (in this case, the temperature inside a dishwashing machine) throughout two cleaning cycles. This graph intends to illustrate the possibility of identifying different cleaning steps in such an evolution, and the possibility of correcting the interpretation thereof for future cleaning cycles.

The local parameter the evolution of which is represented in FIG. 4 is the temperature inside the household appliance (in the case of FIG. 4, the household appliance is a dishwasher). A vertical axis 401 represents the value of the temperature in degrees Celsius. A horizontal axis 402 represents time (in arbitrary units). The first cleaning cycle is identical to a second cleaning cycle 470. The first cleaning cycle comprises a filling phase 410, a "main wash" cycle 420, a first rinse cycle 430, a second rinse cycle which is a last rinse cycle 440 and a drying cycle 450.

During the first cleaning cycle, a first cleaning agent comprising a first composition 411 with enzymes and a second composition 412 having a pH above about 7 is dispensed. These two compositions are typically dispensed within the first about 10 minutes of the cleaning cycle. Since the "main wash" cycle is typically set at the beginning of a cleaning cycle, there is little chance of erroneously dispensing the two compositions too early. As can be seen, the finisher, which forms a third composition 413, adapted for reducing the surface tension of a fluid in the household appliance, is released in the example of FIG. 4 erroneously during a first rinse cycle 430 and not during the last rinse cycle 440.

Upon identifying that the first rinse cycle 430 is not the last rinse cycle, the method of the present disclosure stores the corresponding information by recording at least a portion of the evolution over time of the local parameter for the corresponding cleaning cycle in order to update the database of reference patterns. The information that is stored in the reference patterns can also only be limited to targeted features such as a rise of the temperature up to a certain value, the slope of the rise or decrease in this temperature, a change of the slope, a duration of a cleaning step, a frequency of the oscillations in the values of the local parameter, for example.

When the household appliance runs the same type of cleaning cycle, these special features of the cleaning cycle, that make it identifiable among other cleaning cycles will be recognized when the evolution over time of the local parameter is compared to the updated reference patterns. In FIG. 4, this leads, during the second cleaning cycle 470, to the release of the third composition 414 during the last rinse cycle 460

Another example that is not represented on FIG. 4 enables the method of the present disclosure to correct the timing of the release of the first composition 411 and the second composition 412. Indeed, some pre-wash cycles in dishwashers have temperature evolution patterns that can be misinterpreted as being a main wash cycle followed by a rinse cycle. An automatic programming of the release of the first composition 411 and second composition 412 during the pre-wash would reduce the efficiency of the cleaning process because little amount of the corresponding cleaning agents would be available after a change of the treatment water prior to starting the main wash cycle.

Furthermore, if the pre-wash cycle has a temperature pattern that resembles that of the first cleaning cycle of FIG. 4, a certain amount of finisher would also incorrectly be dispensed during the pre-wash cycle.

The method of the present disclosure identifies that the pre-wash is followed by another cleaning step that is then correctly identified as a proper main wash cycle. The dispensing of an additional and appropriate amount of the first composition 411 and the second composition 412 can then be operated to complete the cleaning cycle efficiently. The existence of this unexpected pre-wash step is then updated in the reference patterns to avoid wasting cleaning agents incorrectly dispensed during the pre-wash cycle.

This makes the method of the present disclosure a self-learning method that can improve the accuracy of the dispensing of cleaning agents after each cleaning cycle. Mistakes in the timing of the dispensing of cleaning agents from one cleaning cycle are used to learn how to recognize a similar cleaning cycle in subsequent runs on the household appliance or other household appliances, for which subsequent runs the mistake in the timing of the dispensing of cleaning agents is not reproduced.

It is to be noted that the method of the present disclosure can be particularly efficient when storage of features that update the reference patterns, and comparison of evolution over time of local parameters to reference patterns rely on approaches using artificial intelligence and predictive analytics. This allows a finer understanding of the relevant features that render a portion of a cleaning cycle unique and recognizable as belonging to a specific cleaning program run by a household appliance.

This approach can further be used to infer information about the current status of the household appliance, such as its damage state, the need to replace certain parts such a faulty spraying arm. It can further recommend placing objects in a different way inside the household appliance when patterns reveal that such a change may better fit with an improvement in the implementation of a cleaning strategy.

The above description is mostly centered on examples applying the method in a dishwashing machine. However, the same logic can also be applied to washing machines, in which different cleaning steps are present and different compositions can be dispensed at different times to achieve a better cleaning performance Other household appliance that perform cleaning operations or assimilated operations such as dryers can also benefit from the above.

The steps of the examples and embodiments described above can be implemented by a processor such as a computer. A computer program product comprising steps of the above-described method can be used to implement the method on a computer.

It is possible to store a computer program comprising instructions to implement the method of the present disclosure on different non-transitory computer readable storage mediums. These could for example comprise a processor or chip, FPGA (field programable gate array), an electronic circuit comprising several processors or chips, a hard drive, a flash or SD card, a USB stick, a CD-ROM or DVD-ROM or Blue-Ray disc, or a diskette.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A non-transitory computer readable storage medium having stored thereon a computer program comprising instructions for execution of a method for setting a time of a release of a cleaning agent during a cleaning cycle in a household appliance, the method comprising:

measuring an evolution over time of a plurality of local parameters inside the household appliance, the plurality of local parameters comprising vibrations induced by the cleaning cycle in the household appliance and temperature inside the household appliance;

obtaining reference patterns of evolutions over time of each of the plurality of local parameters inside the household appliance during at least one cleaning cycle comprising different cleaning steps, a cleaning step among the different cleaning steps being adapted for releasing the cleaning agent at a predetermined adapted time;

comparing each of the measured evolutions over time of the plurality of local parameters to its associated reference pattern to identify the cleaning cycle and to identify a cleaning step within the cleaning cycle when a difference between at least one of the measured evolutions over time of the plurality of local parameters and its associated reference pattern is below a predetermined threshold; and setting the release of the cleaning agent at the predetermined adapted time within the identified cleaning step when the identified cleaning step corresponds to a cleaning step adapted for releasing the cleaning agent, wherein the reference patterns comprise stored recordings of the evolution over time of each of the plurality of local parameters during cleaning cycles run by the household appliance in previous uses thereof.

2. A method for setting a time of a release of a cleaning agent during a cleaning cycle in a household appliance, the method comprising:

measuring an evolution over time of a plurality of local parameters inside the household appliance, the plurality of local parameters comprising vibrations induced by the cleaning cycle in the household appliance and temperature inside the household appliance;

obtaining reference patterns of evolutions over time of each of the plurality of local parameters inside the household appliance during at least one cleaning cycle comprising different cleaning steps, a cleaning step among the different cleaning steps being adapted for releasing the cleaning agent at a predetermined adapted time;

comparing each of the measured evolutions over time of the plurality of local parameters to its associated reference pattern to identify the cleaning cycle and to identify a cleaning step within the cleaning cycle when a difference between at least one of the measured evolutions over time of the plurality of local parameters and its associated reference pattern is below a predetermined threshold;

setting the release of the cleaning agent at the predetermined adapted time within the identified cleaning step when the identified cleaning step corresponds to a cleaning step adapted for releasing the cleaning agent, and releasing the cleaning agent at said predetermined adapted time within the identified cleaning step, wherein the reference patterns comprise stored recordings of the evolution over time of each of the plurality of local parameters during cleaning cycles run by the household appliance in previous uses thereof.

3. The method of claim 2, wherein the cleaning steps comprise a main wash cycle, and a rinse cycle, the method further comprising:

releasing a first cleaning agent when the identified cleaning step corresponds to the main wash cycle, and releasing a second cleaning agent when the identified cleaning step corresponds to the rinse cycle.

4. The method of claim 3, further comprising:

identifying a subsequent rinse cycle occurring after the rinse cycle based on the evolution over time of the plurality of local parameters; and releasing the second cleaning agent during the subsequent rinse cycle.

5. The method of claim 3, further comprising:

identifying a subsequent rinse cycle occurring after the rinse cycle based on the evolution over time of the plurality of local parameters;

identifying a last rinse cycle in the cleaning cycle of the household appliance based on the evolution over time of the plurality of local parameters;

updating the reference patterns by storing a recording of the evolution over time of the plurality of local parameters during at least a portion of the cleaning cycle, and during a subsequent cleaning cycle of the household appliance, an evolution over time of the plurality of local parameters during the subsequent cleaning cycle being identified as matching patterns of the stored recording:

releasing the second cleaning agent during the identified last rinse cycle.

6. The method of claim 3, further comprising:

identifying a subsequent rinse cycle occurring after the rinse cycle based on the evolution over time of the plurality of local parameters;

updating the reference patterns by storing a recording of the evolution over time of the plurality of local parameters during at least a portion of the cleaning cycle, and during a subsequent cleaning cycle of the household appliance, an evolution over time of the plurality of local parameters during the subsequent cleaning cycle being identified as matching patterns of the stored recording:

releasing an amount of the first cleaning agent during the subsequent rinse cycle.

7. The method of claim 2, further comprising:

identifying a nature of the cleaning cycle of the household appliance based on the evolution over time of the plurality of local parameters, the nature being one among a first cleaning cycle comprising two cleaning steps and a second cleaning cycle comprising more than two cleaning steps;

adjusting the predetermined adapted time for releasing the cleaning agent and/or an amount of cleaning agent released based on the identified nature of the cleaning cycle.

8. The method of claim 2, further comprising:

receiving a feedback on a quality of the cleaning cycle from a user;

modifying the predetermined adapted time for the cleaning step and/or associating a different amount of cleaning agent to be released during a cleaning step adapted for releasing the cleaning agent based on the received feedback.

9. The method of claim 1, wherein the predetermined threshold is a difference of 20% or less between an associated reference pattern and at least one of the measured evolutions over time of the plurality of local parameters.

10. The method of claim 2, wherein the predetermined threshold is a difference of 20% or less between an associated reference pattern and at least one of the measured evolutions over time of the plurality of local parameters.

* * * * *